United States Patent [19]

Otobe et al.

[11] Patent Number: 4,491,115

[45] Date of Patent: Jan. 1, 1985

[54] METHOD FOR CONTROLLING FUEL SUPPLY TO AN INTERNAL COMBUSTION ENGINE AT DECELERATION

[75] Inventors: Yutaka Otobe; Akihiro Yamato, both of Shiki, Japan

[73] Assignee: Honda Giken Kogyo Kabushiki Kaisha, Tokyo, Japan

[21] Appl. No.: 498,954

[22] Filed: May 27, 1983

[30] Foreign Application Priority Data

May 28, 1982 [JP] Japan ..... 57-90661

[51] Int. Cl.[3] ..... F02B 3/00

[52] U.S. Cl. ..... 123/493; 123/325

[58] Field of Search ..... 123/492, 493, 325

[56] References Cited

U.S. PATENT DOCUMENTS

| | | | |
|---|---|---|---|
| 3,430,616 | 3/1969 | Glockler | 123/493 |
| 3,703,162 | 11/1972 | Aono | 123/493 |
| 3,735,742 | 5/1973 | Aono | 123/493 |
| 3,736,910 | 6/1973 | Raff | 123/493 |
| 3,747,576 | 7/1973 | Gordon | 123/493 |
| 4,214,307 | 7/1980 | Peterson | 123/493 |
| 4,371,050 | 2/1983 | Ikeura | 123/493 |

OTHER PUBLICATIONS

British Patent Application No. 2,006,336, Published 5/79; No. 2,075,119, Published 11/81; No. 2,098,754, Published 11/82.

*Primary Examiner*—Ronald B. Cox

*Attorney, Agent, or Firm*—Lyon & Lyon

[57] ABSTRACT

A fuel supply control method for controlling the fuel supply to an internal combustion engine at deceleration, wherein the fuel supply to the engine is interrupted when the engine is operating in a predetermined operating region while it is decelerating. The fuel supply is interrupted when the engine is operating in either of the following operating conditions: (1) when the throttle valve is in a substantially fully closed position while the engine is decelerating; and (2) when the throttle valve is in a position other than the substantially fully closed position and simultaneously the engine is operating in a predetermined operating region determined by the engine rotational speed and another engine operation parameter relating to the intake air quantity of the engine, preferably, the intake passage pressure. Preferably, the above predetermined operating region of the engine is determined by the intake passage pressure which has different predetermined values between at fuel cut initiation and at fuel cut termination of the engine, and the difference between the above two different predetermined values of the intake passage pressure is set to vary in response to the rotational speed of the engine. Furthermore, the fuel cut operation is continued until the engine decelerates to predetermined rpm which is set in dependence upon the engine temperature.

5 Claims, 8 Drawing Figures

METHOD FOR CONTROLLING FUEL SUPPLY TO AN INTERNAL COMBUSTION ENGINE AT DECELERATION

BACKGROUND OF THE INVENTION

This invention relates to a fuel supply control method for an internal combustion engine at deceleration, and more particularly to a method of this kind which is adapted to make it possible to accurately determine a fuel cut effecting region of the engine at deceleration of the engine, while the engine is operating in a low engine speed region as well as a high engine speed region, to thereby improve the emission characteristics, fuel consumption, etc. of the engine.

When the intake passage pressure is low, at deceleration of the engine with the throttle valve fully closed, if supply of fuel to the engine is carried out, a large quantity of unburnt fuel is emitted along with the exhaust gases, thereby badly affecting the fuel consumption, emission characteristics, etc. of the engine. Also, in an internal combustion engine having a device for purifying the exhaust gases, like a three-way catalyst, a large quantity of unburnt fuel emitted together with the exhaust gases can cause burning of the three-way catalyst bed, thereby increasing the emission of detrimental exhaust gases. A method for preventing the inconveniences such as described above is already known, which carries out fuel cut while the engine is operating in a predetermined operating region at deceleration.

According to this known method, when the engine rpm is high, if the determination as to whether or not the engine is operating in the above predetermined operating region is made on the basis of the throttle valve opening, it can happen that fuel cut is not carried out even when the intake passage absolute pressure is low enough for fuel cut to be carried out, resulting in the above-mentioned inconveniences. Therefore, it has previously been proposed by the assignee of the present application in Japanese Provisional Patent Publication No. 57-191426 that when the engine rpm is high, the above predetermined operating region be determined on the basis of the intake passage absolute pressure as well as the engine rpm, even if the throttle valve is not fully closed.

However, even when the engine rpm is low, if the determination as to whether or not the engine is operating in the above predetermined operating region is made on the basis of the engine rpm and the intake passage absolute pressure, it becomes difficult to discriminate between the fuel cut operating region in which the throttle valve is almost fully closed and a low load operating region in which the throttle valve is slightly opened (e.g. the throttle valve opening is 10°). For example, if the determination that the conditions for fuel cut stand is made on the basis of a certain value of the intake passage absolute pressure which is a little higher than the intake passage absolute pressure occurring when the engine is idling with the throttle valve fully closed, supply of fuel to the engine can be interrupted contrary to the intention of the driver to continue to operate the engine in the above low load operating condition. According to this manner of determination, therefore, it becomes impossible to achieve a certain engine operating condition desired by the driver, resulting in remarkable deterioration of the driveability of the engine. Moreover, it becomes the more difficult to determine with accuracy the above predetermined operating region because the intake passage absolute pressure varies with changes in atmospheric pressure while the throttle valve is fully closed.

Further, it has also been disclosed in Japanese Provisional Patent Publication No. 57-191426, referred to above, that the predetermined value of the engine rpm and the predetermined value of the intake passage absolute pressure employed for determining whether or not the engine is operating in the above predetermined operating region are each set to values different between at fuel cut initiation and at fuel cut termination, that is, to provide a hysteresis characteristic so as to improve the driveability of the engine. Due to this hysteresis characteristic, the phenomenon can be prevented that alternate fuel cut initiation and fuel cut termination repeatedly take place when the value of either of the engine parameters, i.e. engine rpm, intake passage absolute pressure for determining the fuel cut effecting region fluctuates across a predetermined fuel cut determining value to thereby deteriorate the driveability of the engine.

The value of the difference between a predetermined value of intake passage absolute pressure for determining the fuel cut initiation condition and another predetermined value of same for determining the fuel cut termination condition, that is, the hysteresis margin has hitherto been set only in order to compensate for errors in the value outputted by the intake passage absolute pressure sensor and fluctuations in the engine operating parameters which are estimated empirically and experimentally. However, the value of the above difference should be set by also taking into account the phenomenon that usually the value of intake passage absolute pressure while the engine is operating in a fuel cut or non-combustion operating condition (hereinafter merely called "the motoring condition") is higher than the value of intake passage pressure while the engine is operating in a normal combustion operating condition. That is, the actual intake air quantity supplied to the engine while the engine is operating in a normal combustion operating condition is larger than the intake air quantity when the engine is in the motoring condition, so far as the engine rpm remains constant, or in other words, the charging efficiency of the engine in a normal combustion operating condition is higher than that when the engine is in motoring condition, as generally well known. This means that the intake passage absolute pressure during the motoring condition is higher than that during normal combustion operating condition of the engine, so far as the intake air quantity remains constant. This phenomenon will cause a heavy deterioration in the driveability of the engine when the engine is operating in an operating condition very close to a predetermined fuel cut effecting region. More specifically, if fuel cut is carried out consequently upon the intake passage absolute pressure becoming lower than a predetermined fuel cut determining value, while the engine is slowly decelerating, the intake passage absolute pressure during the motoring operation of the engine increases to a value higher than that assumed when the engine is in a normal combustion operating condition. When the intake passage absolute pressure during the motoring operation becomes higher than the above predetermined fuel cut determining value, fuel cut is terminated on the judgement that the engine is no longer operating in the fuel cut effecting region. Thereafter, if fuel supply to the engine is resumed so as to operate the engine in normal combustion operating condition, the intake passage pressure drops to initiate fuel cut again. This phenomenon repeatedly occurs, resulting in remarkable deterioration of the driveability of the engine.

Further, it is desirable that the fuel cut operation should be continued until the engine decelerates to as low rpm as possible so as not to spoil the emission characteristics and fuel consumption of the engine. However, when the engine is in a cold condition, the sliding parts of the engine have high frictional resistance to make the operation of the engine unstable when the engine speed is very low. Therefore, if the engine rotational speed at which the fuel cut operation is to be terminated is set at too low rpm, engine stall can easily occur after termination of the fuel cut operation, for instance, upon disengagement of the clutch of the engine.

SUMMARY OF THE INVENTION

It is a primary object of the invention to provide a fuel supply control method for an internal combustion engine at deceleration, which is adapted to accurately determine a fuel cut effecting region of the engine while the engine is operating in a low speed region as well as a high speed region, to thereby improve the emission characteristics, fuel consumption, etc. of the engine, as well as to prevent burning of a device for purifying the exhaust gases emitted from the engine.

It is a second object of the invention to provide a fuel supply control method for an internal combustion engine at deceleration, which is adapted to determine a fuel cut effecting region of the engine without being effected by detecting errors of the engine operation parameter sensors and fluctuations in the engine operating parameter values, so as to ensure stable operation of the engine, to thereby improve the driveability of the engine.

It is a third object of the invention to provide a fuel supply control method for an internal combustion engine at deceleration, which is adapted to continue the fuel cut operation at engine deceleration until the engine decelerates to an appropriate value of engine rpm at which the engine will not undergo engine stall even with no fuel supply, thereby improving the emission characteristics, fuel consumption, etc. of the engine.

According to this invention, a fuel supply control method is provided for interrupting the fuel supply to the engine, while the engine is decelerating, which comprises the following steps: (1) determining whether or not the throttle valve is in a substantially fully closed position while the engine is decelerating; (2) interrupting the fuel supply to the engine when it is determined in the step (1) that the throttle valve is in the substantially fully closed position; (3) determining whether or not the engine is operating in a predetermined operating region which is determined by the rotational speed of the engine and another engine operation parameter relating to the intake air quantity of the engine, preferably the intake passage pressure, when it is determined in the step (1) that the throttle valve is in a position other than the fully closed position; (4) and interrupting the fuel supply to the engine, when it is determined in the step (3) that the engine is operating in the above predetermined operating region. Preferably, the above predetermined operating region of the engine is determined by the intake passage pressure downstream of the throttle valve which has different predetermined values between at fuel cut initiation and at fuel cut termination, and the difference between the above two different predetermined values is set to vary in response to the engine rotational speed. More preferably, the difference between the above predetermined values is set to a value corresponding to the difference between a value of the intake passage pressure assumed when the engine is in a non-combustion operating condition and a value of the intake passage pressure assumed when the engine is in a normal combustion operating condition, provided that the engine rotational speed remains the same between the above two operating conditions.

Furthermore, preferably, the fuel cut operation is terminated when the engine rotational speed is lower than a predetermined value which is set to higher values and as the engine temperature becomes lower.

The above and other objects, features and advantages of the invention will be more apparent from the ensuing detailed description taken in conjunction with the accompanying drawings.

DETAILED DESCRIPTION

The present invention will now be described in detail with reference to the drawings.

Figure 1:
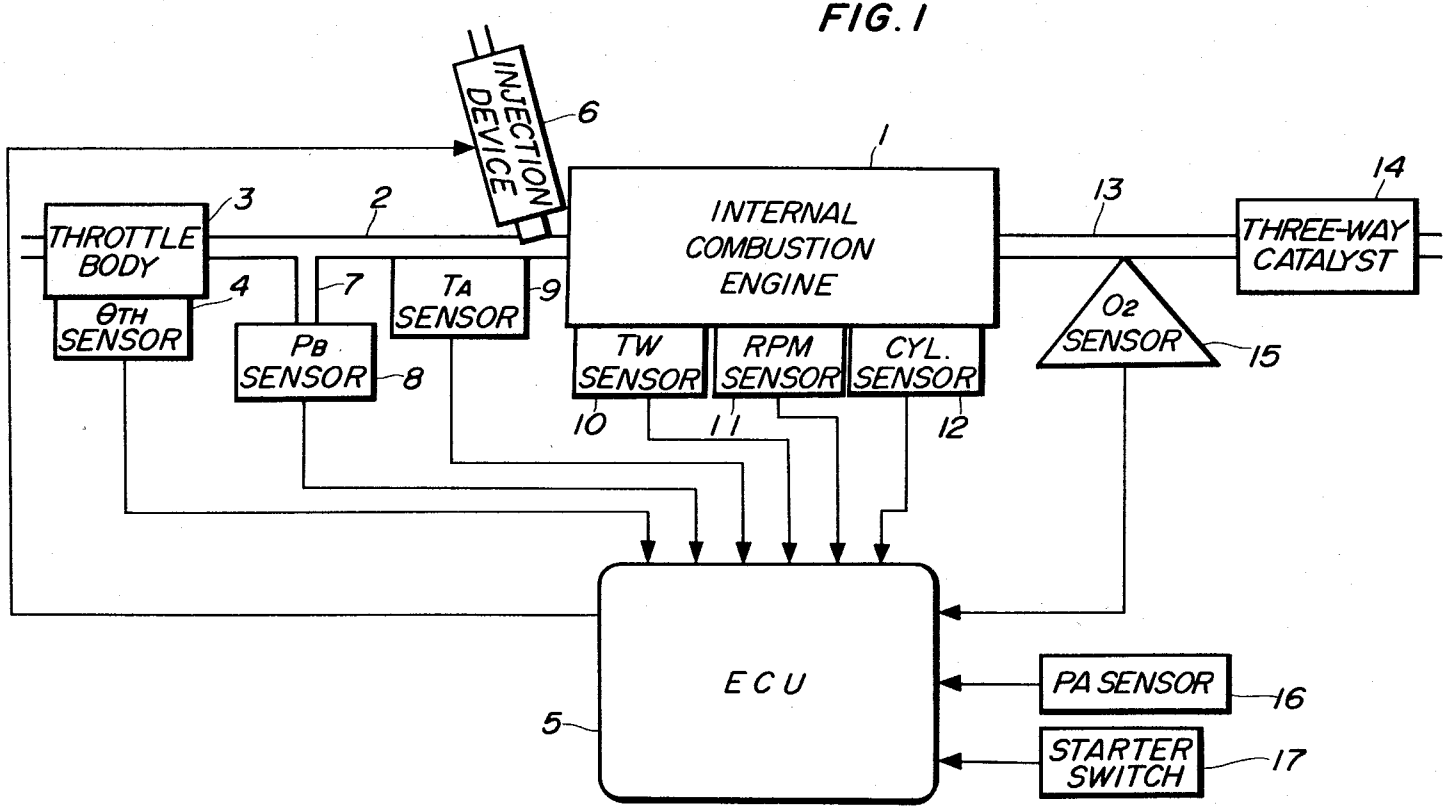
FIG. 1 is a block diagram illustrating the whole arrangement of a fuel supply control system to which is applicable the method according to the present invention.

Referring first to FIG. 1, there is illustrated an example of the whole arrangement of a fuel supply control system for internal combustion engines, to which the present invention is applicable. Reference numeral 1 designates an internal combustion engine which may be a four-cylinder type, for instance, and to which is connected an intake passage 2 with a throttle valve 3 arranged therein. A throttle valve opening sensor 4 is mounted on the throttle valve 3 for detecting its valve opening and is electrically connected to an electronic control unit (hereinafter called "ECU") 5, to supply same with an electrical signal indicative of throttle valve opening detected thereby.

A fuel injection valve 6 is arranged in the intake passage 2 at a location slightly upstream of an intake valve of a corresponding one of the engine cylinders, not shown, and between the engine 1 and the throttle valve 3, for fuel supply to the corresponding engine cylinder. Each of such fuel injection valves 6 is connected to a fuel pump, not shown, and is electrically connected to the ECU 5, in a manner having their valve opening periods or fuel injection quantities controlled by signals supplied from the ECU 5.

On the other hand, an absolute pressure sensor 8 communicates through a conduit 7 with the interior of the intake passage 2 at a location immediately downstream of the throttle valve 3. The absolute pressure sensor 8 is adapted to detect absolute pressure in the intake passage 2 and applies an electrical signal indicative of detected absolute pressure to the ECU 5. An intake air temperature sensor 9 is arranged in the intake passage 2 at a location downstream of the absolute pressure sensor 8 and also electrically connected to the ECU 5 for supplying thereto an electrical signal indicative of detected intake air temperature.

An engine cooling water temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged on a camshaft, not shown, of the engine 1 or a crankshaft of same, not shown. The former 11 is adapted to generate one pulse at a particular crank angle each time the engine crankshaft rotates through 180° degrees, i.e., upon generation of each pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starter switch 17 for actuating the starter of the engine 1, respectively, for supplying an electrical signal indicative of detected atmospheric pressure and an electrical signal indicative of its own on and off positions to the ECU 5.

The ECU 5 operates on the basis of the various engine parameter signals inputted thereto to determine engine operating conditions including the fuel cut effecting conditions as well as to calculate the valve opening period TOUT of the fuel injection valves 6 in response to the determined engine operating conditions by means of the following equation:

$$TOUT = Ti \times K_1 + K_2 \quad (1)$$

wherein, Ti represents a basic value of the fuel injection period and is calculated as a function of the intake passage absolute pressure PBA and the engine rpm Ne, and $K_1$ and $K_2$ represent correction coefficients having their values dependent upon the values of signals from the aforementioned various sensors, that is, the throttle valve opening sensor 4, the intake passage absolute pressure sensor 8, the intake air temperature sensor 9, the engine cooling water temperature sensor 10, the Ne sensor 11, the cylinder discriminating sensor 12, the $O_2$ sensor 15, the atmospheric pressure sensor 16, and the starter switch 17, and are calculated by the use of predetermined equations, so as to optimize the startability, emission characteristics, fuel consumption, accelerability, etc. of the engine.

The ECU 5 supplies driving signals to the fuel injection valves 6 to open same with a duty factor corresponding to the valve opening period TOUT calculated in the above manner.

Figure 2:
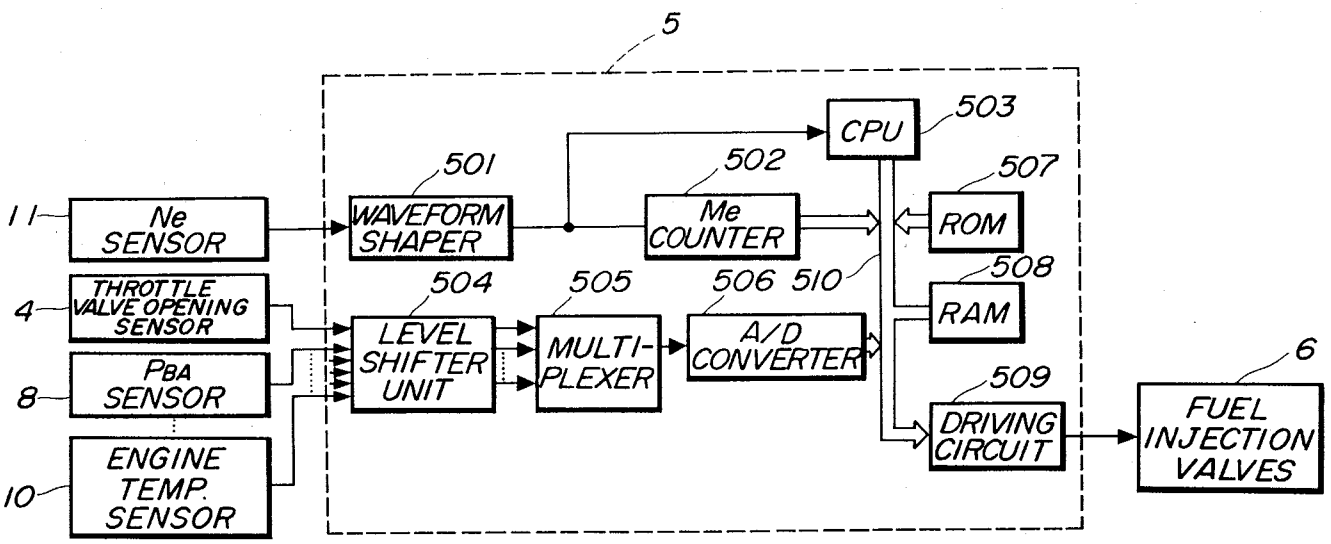
FIG. 2 is a circuit diagram showing an electrical circuit within the electronic control unit (ECU) 5 in FIG. 1.

FIG. 2 shows an electrical circuit within the ECU 5 in FIG. 1. The engine rpm signal from the Ne sensor 11 in FIG. 1 is applied to a waveform shaper 501, wherein it has its waveform shaped, and supplied to a central processing unit (hereinafter called "CPU") 503 as a TDC signal as well as to a Me counter 502. The Me counter 502 counts the interval of time between a preceding pulse of the engine rpm signal generated at a predetermined crank angle of the engine and a present pulse of the same signal generated at the predetermined crank angle inputted thereto from the Ne sensor 11, and accordingly its counted value Me corresponds to the reciprocal of the actual engine rpm Ne. The Me counter 502 supplies the counted value Me to the CPU 503 via a data bus 510.

The respective output signals from the throttle valve sensor 4, the intake passage absolute pressure PBA sensor 8, the engine cooling water temperature sensor 10, all appearing in FIG. 1, and other sensors, if any, have their voltage levels shifted to a predetermined voltage level by a level shifter unit 504 and applied to an analog-to-digital converter 506 through a multiplexer 505. The A/D converter 506 successively converts the above signals into digital signals and supplies them to the CPU 503 via the data bus 510.

The CPU is also connected to a read-only memory (hereinafter called "ROM") 507, a random access memory (hereinafter called "RAM") 508, and a driving circuit 509, through the data bus 510. The RAM 508 temporarily stores the resultant values of various calculations from the CPU 503, while the ROM 507 stores a control program executed within the CPU 503, a basic fuel injection period Ti map for the fuel injection valves 6, predetermined fuel cut determining values, etc. The CPU 503 executes the control program stored in the ROM 507 to calculate the valve opening period TOUT for the fuel injection valves 6 in response to the various engine parameter signals referred to before, and supplies the calculated TOUT value to the driving circuit 509 via the data bus 510. The driving circuit 509 supplies driving signals corresponding to the above TOUT value to the fuel injection valves 6 to open same.

Figure 3:
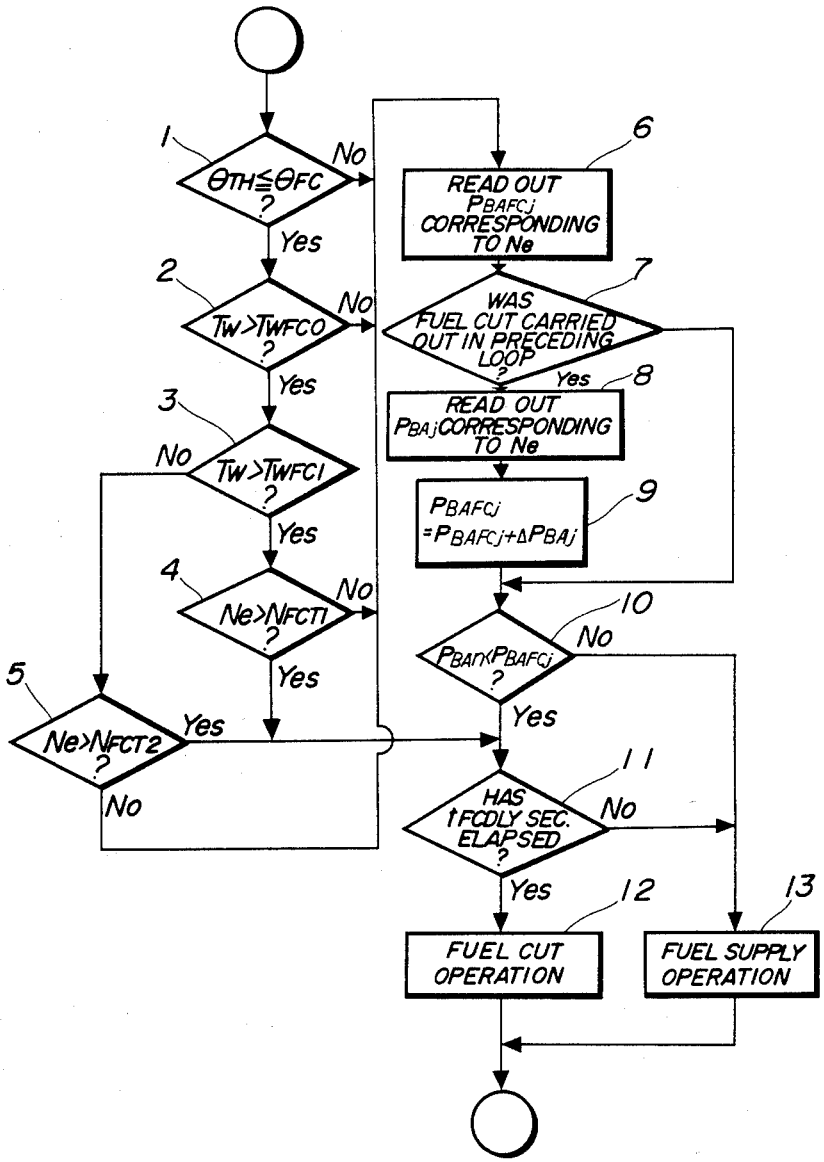
FIG. 3 is a flow chart showing a program for determining the fuel cut effecting region of the engine according to the method of the invention.

FIG. 3 is a flow chart of a routine of the control program executed within the CPU 503 in FIG. 2 to determine whether or not the engine is operating in the predetermined fuel cut effecting region.

Figure 4:
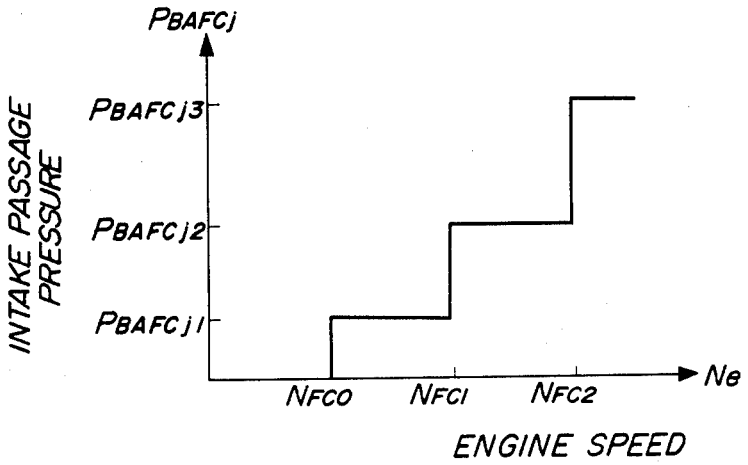
FIG. 4 is a view showing a table of the relationship between engine rpm Ne and fuel cut determining intake passage absolute pressure PBAFCj.

First, it is determined whether or not the throttle valve opening $\theta$TH value is smaller than a predetermined value $\theta$FC at the step 1 in FIG. 4. The above predetermined value $\theta$FC is a value used for determining whether or not the throttle valve is in a substantially closed position and is set to a value a little higher than zero (e.g. +2° of throttle valve opening at engine idling) so as to compensate for an aging change in the fully closed position due to abrasion, etc. In actual practice, the above predetermined fuel cut determining value $\theta FC$ may be set to values different between at fuel cut initiation and at fuel cut termination to provide a hysteresis characteristic for the fuel cut initiating and interrupting actions.

Figure 5:
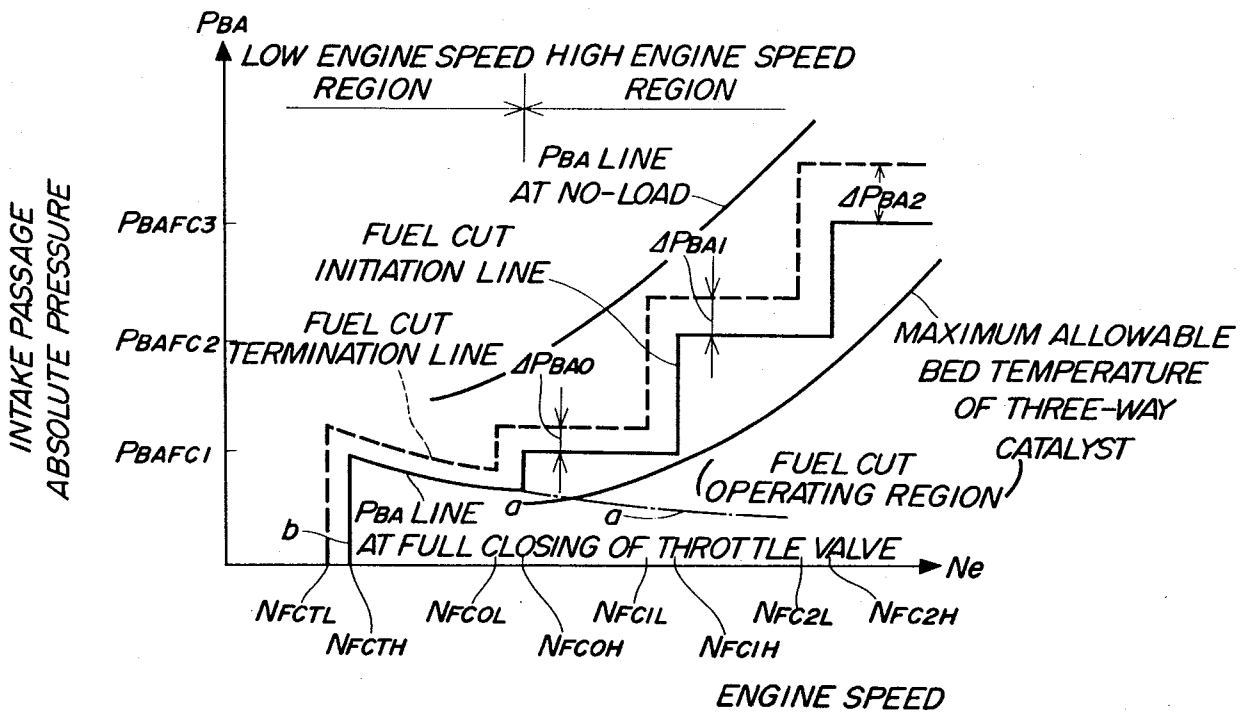
FIG. 5 is graph showing the fuel cut effecting region.

If the answer to the question at the step 1 is no, that is, when the throttle valve is not in a substantially closed position, the program proceeds to the step 6 to read out a fuel cut determining PBAFCj value of the intake passage absolute pressure corresponding to the engine rpm Ne from the ROM 507 in FIG. 2. FIG. 4 is a view showing, by way of example, a table of the relationship between the engine rpm Ne and the fuel cut determining value PBAFCj, wherein three predetermined engine rpm values $NFC_0$ (1950 rpm), $NFC_1$ (2950 rpm), and $NFC_2$ (3950 rpm) are provided, while predetermined fuel cut determining absolute pressure PBAFCj values, $PBAFC_1$ (208 mmHg), $PBAFC_2$ (228 mmHg), $PBAFC_3$, (248 mmHg) are provided in relation to the respective above predetermined rpm values. As shown in FIG. 5, it is necessary that the fuel cut determining absolute pressure PBAFCj should be set at values falling within a range between an absolute pressure PBA line assumed with no load on the engine when the accelerator pedal is stepped on with the clutch disengaged or with the transmission in its neutral position, and another absolute pressure PBA line assumed with the throttle valve in its full closing position. Also, the fuel cut determining absolute pressure PBAFCj has to be set so as to exceed a further absolute pressure PBA line corresponding to the maximum allowable bed temperature of the three-way catalyst below which the temperature of the three-way catalyst rises to an abnormal extent. If the above fuel cut determining absolute pressure PBAFCj is set to a constant absolute pressure value PB irrespective of an increase in the engine rpm, the amount of exhaust gases flowing into the three-way catalyst per unit time increases, and consequently the amount of detrimental ingredients, particularly unburned fuel for reaction in the catalyst per unit time increases, so that the temperature of the three-way catalyst can easily reach the burning point. Therefore, it is necessary to set the value of fuel cut determining absolute pressure PBAFCj so as to increase with the increase of the engine rpm in order to reduce the amount of exhaust gas ingredients for reaction in the catalyst per unit time.

The above fuel cut determining actual engine rpm values are provided with a hystersis margin, e.g. $\pm 50$ rpm. The fuel cut determining intake passage absolute pressure values are also provided with a hysteresis margin of $\Delta PBAj$, as hereinafter explained in detail. In FIG. 5, the solid line in the graph represents the fuel cut initiation line while the broken line represents the fuel cut termination line.

Reverting next to FIG. 3, it is determined whether or not fuel cut was carried out in the previous loop at the step 7, in FIG. 3. If fuel cut was not carried out in the last loop, that is, if the answer to the question at the step 7 is no, the program skips to the step 10 to determine whether or not a value of an absolute pressure signal PBAn outputted by the intake passage absolute pressure sensor 8 is smaller than the fuel cut determining PBACFj value read out at the step 6. If the answer to the above question at the step 10 is no, the program proceeds to the step 13 to execute the control program for calculating the valve opening period TOUT of the fuel injection valve 6 by the use of the aforementioned equation (1). On the other hand, if the answer to the question at the step 10 is yes, that is, if it is determined that the engine is operating in the fuel cut effecting region, it is determined at the step 11, whether or not a predetermined period of time tFCDLY (e.g. 2 seconds) has elapsed since the engine started operating in the fuel cut effecting region. This time lag is provided for preventing any misconceived execution of fuel cut operation due to erraneous signals caused by noise and other external disturbances. If the predetermined period of time tFCDLY has not elapsed, that is, if the answer to the above question is no, the step 13 is executed. On the other hand, if the answer to the above question is yes, that is, the predetermined period of time tFCDLY has elapsed, the program proceeds to the step 12 to effect fuel cut.

Figure 6:
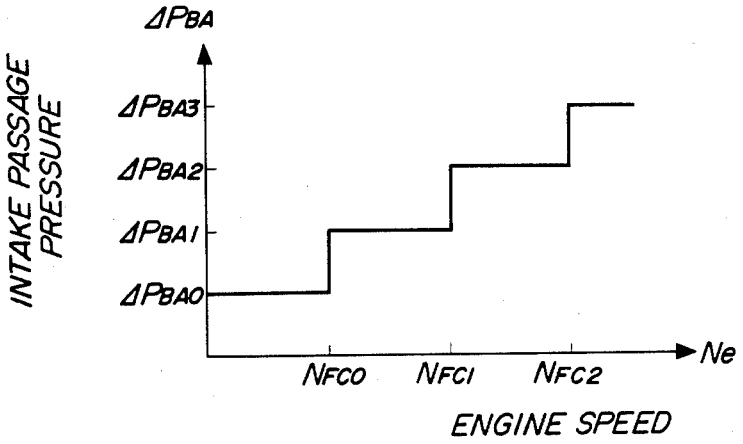
FIG. 6 is a view showing a table of the relationship between engine rpm Ne and the hysteresis margin ΔPBAj of fuel cut determining intake passage absolute pressure PBAFCj.

If the answer to the question at the above step 7 is yes, that is, if fuel cut was effected in the previous loop, the value of hysteresis margin $\Delta PBAj$ corresponding to the engine rpm Ne is read out from the ROM 507 in FIG. 2. FIG. 6 shows a table of the relationship between the engine rpm Ne and the hysteresis margin $\Delta PBAj$, wherein, by way of example, there are provided the three aforementioned predetermined engine rpm values $NFC_0$, $NFC_1$ and $NFC_2$ having four corresponding hysteresis margins $\Delta PBA_0$ (32 mmHg), $\Delta PBA_1$ (52 mmHg), $\Delta PBA_2$ (64 mmHg), and $\Delta PBA_3$ (70 mmHg). These hysteresis margins are provided for application to determine the fuel cut determining absolute pressure value at fuel cut termination condition of the engine at the step 9.

Figure 7:
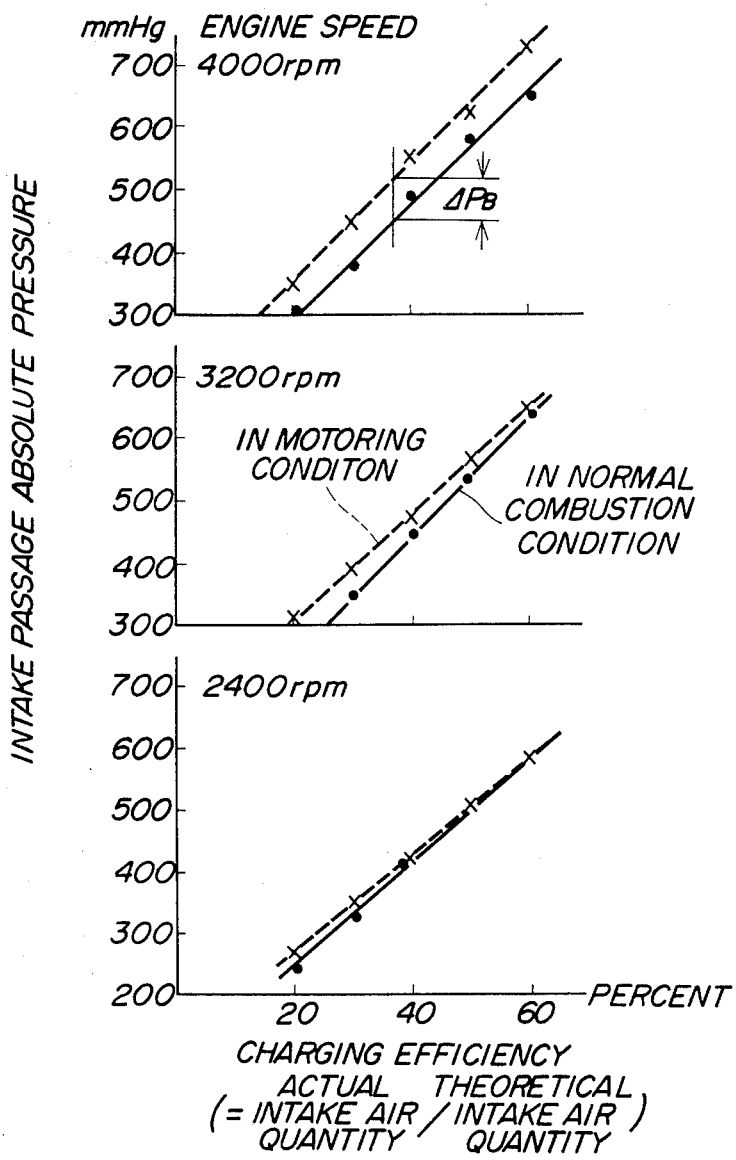
FIG. 7 is graph showing the relationship between values of intake passage absolute pressure occurring during motoring operation of the engine and during normal combustion operation of the engine and the charging efficiency of the engine.

In this way, the hysteresis margin $\Delta PBAj$ is set to larger values corresponding to increases in the engine rpm for the following reasons: FIG. 7 shows test results showing differences in value between intake passage absolute pressure occurring at engine operation in fuel cut effecting motoring condition and that occurring at engine operation in normal combustion condition. As shown by the test results in FIG. 7, so far as the intake passage absolute pressure remains constant, the charging efficiency of the engine at normal combustion operation (shown by the solid lines in FIG. 7) is higher than that at motoring operation (shown by the broken lines in FIG. 7), that is, the actual intake air quantity being supplied to the engine in normal combustion operating condition is larger than that at motoring operation, as is already known. Conversely, the intake passage absolute pressure at motoring operation of the engine is larger than that at normal combustion operation, so long as the same quantity of intake air is supplied to the engine. Now, when the intake passage absolute pressure becomes lower than a predetermined fuel cut determining value at slow deceleration of the engine, to carry out fuel cut, the intake passage absolute pressure shifts from a value at normal combustion operation (a solid line in FIG. 7) to a value at motoring operation (a broken line in FIG. 7) and therefore, the intake passage absolute pressure increases to a value higher than the above predetermined fuel cut determining value, to thereby cause termination of the fuel cut. Next, when the engine is operated with combustion in the engine cylinders (hereinafter called "combustive operating condition") due to the resumption of fuel supply to the engine, the intake passage absolute pressure decreases to result in a second fuel cut operation. If such fuel cut initiation and termination operations are repeated, it can result in great deterioration of the driveability of the engine. In order to prevent such a situation, the aforementioned hysteresis margin is provided for the predetermined fuel cut determining value of the intake passage absolute pressure between fuel cut initiation condition and fuel cut termination condition of the engine, and this hysteresis margin, i.e. the difference between two predetermined values should at least be larger than a ΔPB value of the difference between two absolute pressures at motoring operation and at normal combustion operation, illustrated in FIG. 7. As the difference ΔPB increases along with an increase in the engine rpm, as illustrated by the test results in FIG. 7, the difference between the predetermined fuel cut determining values of the absolute pressure for fuel cut initiation and for fuel cut termination, that is, the hysteresis margin ΔPBAj has also to be set so as to increase along with an increase in the engine rpm. Referring again to FIG. 3, at the step 9, an addition is made of a fuel cut determining value PBAFCj read out at the step 6 is added to a corresponding value of the hysteresis margin ΔPBAj set in a manner explained hereinbefore, to obtain a predetermined PBAFCj value for fuel cut termination. When the PBAn value of the absolute pressure signal from the intake passage absolute pressure sensor 8 is smaller than the above calculated PBAFCj value (that is, the answer to the question at the above step 10 is yes), fuel cut is continued at the step 12. When the absolute pressure signal PBAn value becomes higher than the above calculated PBAFCj value, it is determined that the engine is no longer operating in the fuel cut region, and the step 13 is executed.

As explained above, even if the throttle valve is not in a substantially closed position, when the engine rpm Ne is high, the determination whether or not fuel cut is necessary is made on the basis of the fuel cut determining absolute pressure value PBAFCj corresponding to the engine rpm, as shown in FIG. 5.

Figure 8:
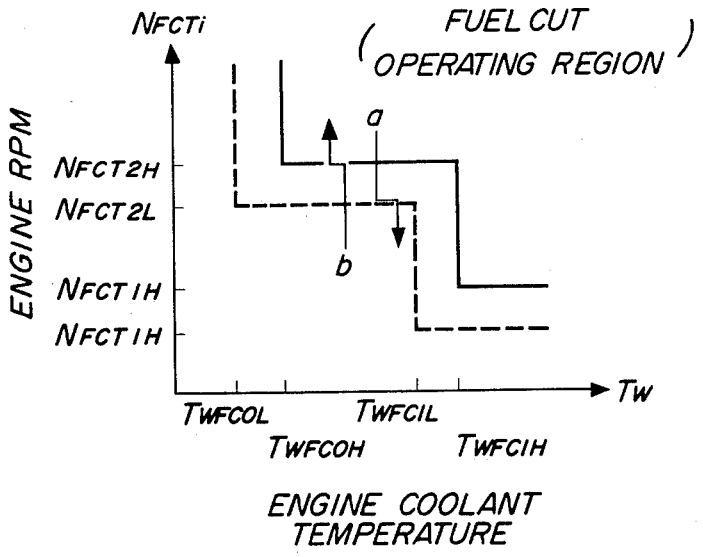
FIG. 8 is a view showing a table of the relationship between engine cooling water temperature TW and fuel cut determining rpm NFCTi.

Next, if the answer to the question at the step 1 is yes (the line a at full closing of the throttle valve in FIG. 5), it is determined at the step 2 through the step 5, whether or not the engine rpm Ne is higher than a predetermined rpm NFCT (the line b of engine rpm NFCT in FIG. 5), which is set in dependence upon the engine cooling water temperature TW. When the engine cooling water temperature which represents the engine temperature is low, the sliding parts of the engine have large frictional resistance, making the engine operation unstable while the engine is operating in a low speed region. Therefore, unless the fuel cut determining rpm NFCT for fuel cut operation at a low temperature of the engine is set to a value higher than that for same after completion of warming-up of the engine, there is a much possibility that the engine is stalled when the clutch is disengaged immediately after the termination of the fuel cut operation. For this reason, when the engine cooling water temperature is low, the fuel cut determining rpm NFCT is set to a relatively high value, to thereby prevent engine stall after terminating the fuel cut. FIG. 8 shows, by way of example, a table of the relationship between engine cooling water temperature TW and fuel cut determining rpm NFCTi. According to this table, for example, two engine cooling water temperatures $TWFC_0$ (65° C.) and $TWFC_2$ (80° C.) are provided while two predetermined fuel cut determining rpm values $NFCT_1$ (850 rpm) and $NFCT_2$ (1350 rpm) are provided in relation to the above predetermined cooling water temperature values. The above fuel cut determining engine rpm values are provided with a hysteresis margin, e.g. ±50 rpm. That is, as to the value $NFCT_2$, to interrupt the fuel cut operation, the actual engine rpm has to be lower than NFCT2L (=1300 rpm) as shown in a of FIG. 8, while on the other hand, to resume the same operation it should be higher than NFCT2H (=1400 rpm) as shown in b of the same figure. In this way, by providing a hysteresis margin of ±50 rpm at the transition between the fuel cut operating region and an adjacent non-fuel cut operating region, fine fluctuations in the engine rpm Ne can be substantially absorbed to ensure stable engine operation.

Reverting to FIG. 3, first of all, it is determined at the step 2, whether or not the engine cooling water temperature TW is higher than a predetermined value $TWFC_0$ (e.g. 65° C.). If the answer to the above question is no, that is, when the engine cooling water temperature TW is lower than the predetermined value $TWFC_0$, the program proceeds to execute the steps starting from the step 6. As shown in FIG. 5, when the engine is operating in a high speed region ($Ne > NFC_0$), the absolute pressure PBAn af full closing of the throttle valve is below the fuel cut initiation line, and accordingly fuel cut is carried out even if the engine cooling water temperature TW is lower than the predetermined value $TWFC_0$, except during a short period of time immediately after deceleration of the engine. On the other hand, when the engine is operating in a low speed region, the fuel cut determining value PBAFCj of the absolute pressure is set to zero at the step 6, and consequently the intake passage absolute pressure value PBAn, which varies along the line a at full closing of the throttle valve, in FIG. 5, is inevitably determined to be higher than the aforementioned fuel cut determining value PBAFCj at the step 10, causing the program to execute the step 13. That is, when the engine is operating in a low speed range ($Ne > NFC_0$), fuel cut is not carried out when the engine cooling water temperature TW is lower than the predetermined value $TWFC_0$.

If the answer to the question at the step 2 is yes, that is, when the engine cooling water temperature TW is higher than the predetermined value $TWFC_0$, it is further determined whether or not the above engine cooling water temperature TW is higher than a second predetermined value $TWFC_1$ at the step 3. If the answer to the above question at teh step 3 is no, that is, when the relationship $TWFC_0 < TW \leqq TWFC_1$ stands, it is determined at the step 5 whether or not the engine rpm Ne is higher than a predetermined rpm $NFCT_2$, shown in FIG. 8. If the engine rpm Ne is higher than the predetermined rpm $NFCT_2$, the program proceeds to the step 11 to determine whether or not the aforementioned predetermined period of time tFCDLY has elapsed from the time the engine operation in the fuel cut region was detected for the first time, and to carry out fuel cut (step 12) when the answer to the above question is in the affirmative. If it is determined at the step 5 that the engine rpm Ne is smaller than the predetermined rpm $NFCT_2$, the program proceeds to the steps starting from the step 6 and in the same way as explained before, it then proceeds to the step 13 without fuel cut being carried out.

If the answer to the question at the step 3 is yes, that is, when the engine cooling water temperature TW is higher than the second predetermined value $TWFC_1$, it is determined whether or not the engine rpm Ne is higher than the predetermined rpm $NFCT_1$, and when the engine rpm Ne is higher than the above predetermined rpm $NFCT_1$, in the same way as at the above step 5, the program proceeds to the step 11 to determine whether or not the predetermined period of time tFCDLY has elapsed, and upon the lapse of the same period, to the step 12 to carry out the fuel cut. On the other hand, if the engine rpm Ne is smaller than the predetermined rpm $NFCT_1$, the step 13 is executed, as there is no need for fuel cut.

Incidentally, in place of the intake passage absolute pressure PB, any other engine parameter relating to the intake air quantity of the engine, e.g. intake air quantity per se, or throttle valve opening may alternatively be used for determining whether or not the engine is operating in the fuel cut effecting region while the engine is operating in a high speed region.

What is claimed is:

1. A method for controlling the fuel supply to an internal combustion engine having an intake passage and a throttle valve arranged therein and at least one cylinder, at deceleration thereof, comprising the steps of: (1) determining whether or not the throttle valve is in a substantially fully closed position while the engine is decelerating; and (2) interrupting the fuel supply to all of said at least one cylinder of the engine when it is determined in said step (1) that the throttle valve is in said substantially fully closed position; characterized in that: said method comprises further steps of: (3) determining whether or not the engine is operating in a predetermined low load operating region in which [is determined by] the rotational sped of the engine is higher than a predetermined speed and another engine operation parameter relating to the intake air quantity of the engine has a value less than a predetermined value, when it is determined in said step (1) that the throttle valve is in a position other than said substantially fully closed position; [(4) and] and (4) interrupting the fuel supply to the engine, when it is determined in said step (3) that the engine is operating in said predetermined low load operating region.

2. A method for controlling the fuel supply to an internal combustion engine having an intake passage and a throttle valve arranged therein, at deceleration thereof, comprising the steps of: (1) determining whether or not the throttle valve is in a substantially fully closed position while the engine is decelerating; (2) interrupting the fuel supply to the engine when it is determined in said step (1) that the throttle valve is in said substantially fully closed position; (3) determining whether or not the engine is operating in a predetermined operating region which is determined by the rotational speed of the engine and another engine operation parameter relating to the intake air quantity of the engine, when it is determined in said step (1) that the throttle valve is in a position other than said substantially fully closed position; (4) and interrupting the fuel supply to the engine, when it is determined in said step (3) that the engine is operating in said predetermined region, wherein said another engine operation parameter relating to the intake air quantity of the engine is pressure in the intake passage of the engine at a location downstream of said throttle valve, and wherein said predetermined operating region of the engine is determined by the intake passage absolute pressure which has two predetermined values different between at fuel cut initiation and at fuel cut termination of the engine, the difference between said two different predetermined values of the intake passage pressure being adapted to vary in response to the rotational speed of the engine.

3. A method as claimed in claim 1, wherein said another engine operation parameter relating to the intake air quantity of the engine is pressure in the intake passage of the engine at a location downstream of said throttle valve.

4. A method as claimed in claim 1, wherein said predetermined speed is set to higher values as the temperature of the engine becomes lower.

5. A method as claimed in claim 2, wherein the difference between said different predetermined values of the intake passage pressure is set to a value corresponding to the difference between a value of the intake passage pressure assumed when the engine is in a non-combustion operating condition and a value of the intake passage pressure assumed when the engine is in a normal combustion operating condition, provided that the rotational speed of the engine remains the same between said two operating conditions of the engine.

* * * * *

UNITED STATES PATENT AND TRADEMARK OFFICE

CERTIFICATE OF CORRECTION

PATENT NO. : 4,491,115

DATED : January 1, 1985

INVENTOR(S) : Yutaka Otobe; Akihiro Yamato

It is certified that error appears in the above-identified patent and that said Letters Patent are hereby corrected as shown below:

Column 11, lines 25 to 26, words "[is determined by]" deleted; line 32, words "[(4) and]" deleted.

Signed and Sealed this

*Twenty-first* Day of *May 1985*

[SEAL]

*Attest:*

DONALD J. QUIGG

*Attesting Officer*

*Acting Commissioner of Patents and Trademarks*